US007621244B2

(12) United States Patent
Matsuda et al.

(10) Patent No.: US 7,621,244 B2
(45) Date of Patent: Nov. 24, 2009

(54) TITANIUM ALLOY TAPPET, MANUFACTURING METHOD THEREOF, AND JIG USED IN MANUFACTURING TAPPET

(75) Inventors: Yoshimoto Matsuda, Kobe (JP); Aki Kodai, Akashi (JP); Kozo Isano, Kobe (JP); Hideyuki Ogishi, Akashi (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 116 days.

(21) Appl. No.: 11/377,241

(22) Filed: Mar. 15, 2006

(65) Prior Publication Data

US 2006/0243237 A1 Nov. 2, 2006

(30) Foreign Application Priority Data

Mar. 16, 2005 (JP) ..... 2005-75567

(51) Int. Cl.
*F01L 1/14* (2006.01)

(52) U.S. Cl. ..... 123/90.48; 123/90.51; 29/888.03

(58) Field of Classification Search ..... 123/90.51, 123/90.48, 90.52, 90.53; 29/888.03, 888.43, 29/DIG. 16, DIG. 19, DIG. 36, DIG. 45
See application file for complete search history.

(56) References Cited

U.S. PATENT DOCUMENTS 5,129,372 A * 7/1992 Seiberth et al. ..... 123/90.48
5,249,554 A * 10/1993 Tamor et al. ..... 123/90.51
6,237,441 B1 * 5/2001 Nishioka et al. ..... 74/569
6,367,439 B1 * 4/2002 Nishioka et al. ..... 123/90.51
7,086,362 B2 * 8/2006 Mabuchi et al. ..... 123/90.52

FOREIGN PATENT DOCUMENTS

| | | | |
|---|---|---|---|
| JP | 09-264107 | | 10/1997 |
| JP | 10018023 | A * | 1/1998 |
| JP | 2000-327484 | | 11/2000 |
| JP | 2000327484 | A * | 11/2000 |
| JP | 2001-131605 | | 5/2001 |
| JP | 2002-038912 | | 2/2002 |
| JP | 2003-041359 | | 2/2003 |
| JP | 2003-222143 | | 8/2003 |
| JP | 2004-307894 | | 11/2004 |
| JP | 2004-308851 | | 11/2004 |
| JP | 2005-002801 | | 1/2005 |

OTHER PUBLICATIONS

Abstract of JP10018023A.*
Abstract of JP200327484A.*
Abstract of JP10018023A, Jan. 1998; previously furnished.*
Abstract of JP200327484A, Nov. 2000; previously furnished.*

* cited by examiner

*Primary Examiner*—Zelalem Eshete
(74) *Attorney, Agent, or Firm*—Alleman Hall McCoy Russell and Tuttle LLP

(57) ABSTRACT

A titanium alloy tappet that is slidable at a high speed is provided by covering shortcomings of lightweight and high-strength titanium alloy. A surface 1A of at least a slidable portion of the tappet 1 for use with a valve system is subjected to a carburizing process.

11 Claims, 2 Drawing Sheets

TITANIUM ALLOY TAPPET, MANUFACTURING METHOD THEREOF, AND JIG USED IN MANUFACTURING TAPPET

BACKGROUND OF THE INVENTION

1. Field of the Invention

The present invention relates to a titanium alloy tappet for use with valve systems in vehicles such as motorcycles, a method of manufacturing the titanium alloy tappet, and a jig effectively used in the method of manufacturing the titanium alloy tappet.

2. Description of the Related Art

For four-wheeled vehicles and two-wheeled vehicles, attempts have been made to clean an exhaust gas, reduce a noise, and achieve a high power output and low fuel consumption.

In order to achieve the high power output and the low fuel consumption, it is essential to equip lightweight components in the vehicles. To be specific, lightweight components of an engine or the like, for example, tappet for use with a valve system have been developed. The present applicant has already filed an application of an invention of the lightweight tappet (see Japanese Laid-Open Patent Application Publication No. 2000-327484). The conventional tappet that is made of steel is unable to be made thinner because its stiffness is decreased. Titanium alloy may be used because of its light weight and strength. However, the titanium alloy has a low sliding ability, i.e., a large friction coefficient, and tends to stick. If the titanium alloy is formed into a component adapted to slide at a high speed, for example, an engine speed of 15,000 rpm to 18,000 rpm, then sticking is more likely to occur. For this reason, it is difficult to replace the steel with the titanium alloy. In the above mentioned invention, the applicant made an attempt to apply a method of forming a DLC (diamond like carbon) film on a surface of the steel to reduce a friction resistance to the titanium alloy. But, the titanium alloy is incompatible with a forming process of the DLC film. Specifically, the titanium alloy is lower in adhesion strength with respect to the DLC film than the steel or other material, and therefore the DLC film is more likely to peel off from the surface of the titanium alloy after a short-time operation. Therefore, an improvement is needed to form the DLC film on a slidable portion made of the titanium alloy.

SUMMARY OF THE INVENTION

The present invention has been made under the circumstances, and an object of the present invention is to provide a titanium alloy tappet capable of sliding at a high speed by covering shortcomings of lightweight and high-strength titanium alloy, a manufacturing method thereof, and a jig that is useful in carrying out the manufacturing method.

The object of the present invention is able to be achieved by the titanium alloy tappet configured as described below, the manufacturing method thereof, and the jig.

According to one aspect of the present invention, there is provided a titanium alloy tappet for use with a valve system, a surface of at least a slidable portion of the tappet being subjected to a surface hardening process.

In accordance with the titanium alloy tappet configured as described above, its surface hardness increases because of the surface hardening process applied to its surface. As a result, anti-sticking properties and durability improve. For example, when the surface hardening process is a carburizing process, a carbonized layer is formed on the surface. As a result, the surface hardness increases and anti-sticking properties improve. In addition, durability significantly improves. When the carburizing process is employed, a white layer is not formed on the surface, and therefore, a DLC film can be easily formed thereon.

When the surface hardening process is a nitriding process, a nitrided layer is formed on the surface. As a result, anti-sticking properties and durability improve. It is advantageous that the nitriding process is performed at a temperature lower than that of the carburizing process.

A diamond like carbon film is formed on the surface that has been subjected to the carburizing process.

In accordance with the titanium alloy tappet constructed above according to another aspect of the present invention, the surface of the slidable portion is subjected to the carburizing process to allow the carbonized layer to be formed on the surface. This increases surface hardness. Then, the DLC film is formed on the surface of the carbonized layer. This reduces friction resistance, and improves wear resistance.

In the titanium alloy tappet, the tappet may be desirably formed of titanium alloy which is Ti-6Al-4V.

According to another aspect of the present invention, there is provided a method of manufacturing a titanium alloy tappet for use with a valve system, comprising forming the tappet to have a tubular shape and a bottom corresponding to a contact portion configured to contact a cam in the valve system; and causing the tappet to be subjected to a carburizing process using a jig placed in contact with an inner wall surface of the tappet except for a corner portion of the inner wall surface of the bottom of the tappet and a center region of the inner wall surface of the bottom of the tappet.

In accordance with the method of manufacturing the titanium alloy tappet of the present invention configured as described above, by the carburizing process, the carbonized layer is formed on an outer wall surface of the tappet and the inner wall surface of the upper end of the tappet which are slidable portions. In addition, by utilizing heat generated during the carburizing process (thermal deformation of a desired region of the tappet because of the configuration of the jig), the surface of the upper end of the tappet is formed to have a crowning shape that is curved upward at a center thereof to enable the upper end of the tappet to substantially make point-contact with a cam surface of the valve system. Whereas the upper end of the conventional tappet is formed to have a round surface that is curved upward at a center thereof by using a grinder or other machine, after completing thermal treatment or the like, the upper end of the tappet of the present invention can be formed to have a round surface by using heat of the carburizing process, to be specific, heat deformation and support of the jig from below.

The method of manufacturing the titanium alloy tappet may further comprise: after the carburizing process, forming a diamond like carbon film, which is able to achieve the titanium alloy tappet according to another aspect of the present invention.

In the method of manufacturing the titanium alloy tappet, the tappet may be desirably formed of titanium alloy which is Ti-6Al-4V.

In the method of manufacturing the titanium alloy tappet, the carburizing process may be a plasma carburizing process carried out under a condition in which a temperature of a surface layer of titanium alloy is 500° C. to 850° C. Since the temperature of the surface layer is 500° C. or higher, carbon (C) and nitrogen (N) are diffused on the surface layer in a desired condition. In addition, since the temperature of the surface layer is 850° C. or lower, distortion caused by the thermal treatment does not substantially become problematic.

The method of manufacturing the titanium alloy tappet may further comprise: after the carburizing process and before formation of the diamond carbon film, removing an oxidization film by one of grinding, etching, shot blasting, shot peening or sputtering. This significantly improves adhesion between the titanium alloy and the DLC film. As a result, the DLC film is less likely to peel off from the surface of the titanium alloy in a short time, and reduction of the friction resistance and improvement of the wear resistance continue for a long time period. The oxidization film may be desirably removed by one of the above processes, because the existing tool or machine is used.

In the method of manufacturing the titanium alloy tappet, the DLC film is formed by a physical deposition process or a chemical deposition process.

The titanium alloy tappet constructed above is able to obviate shortcomings of titanium alloy that is lightweight and has high strength by surface treatment. As a result, the lightweight titanium alloy tappet is able to slide at a high speed.

In accordance with the method of manufacturing the titanium alloy tappet of the present invention constructed above, a suitable manufacturing method of the titanium alloy tappet of the present invention is provided.

The present invention is widely applicable to engines of motorcycles or other vehicles, or other general machines.

The above and further objects and features of the invention will more fully be apparent from the following detailed description with accompanying drawings.

DESCRIPTION OF THE PREFERRED EMBODIMENTS

Hereinafter, an embodiment of the present invention will be described specifically with reference to the attached drawings. By way of example, a tappet used in an air-intake system and an exhaust system of an internal combustion engine of a motorcycle will be described.

Embodiment 1

Figure 1:
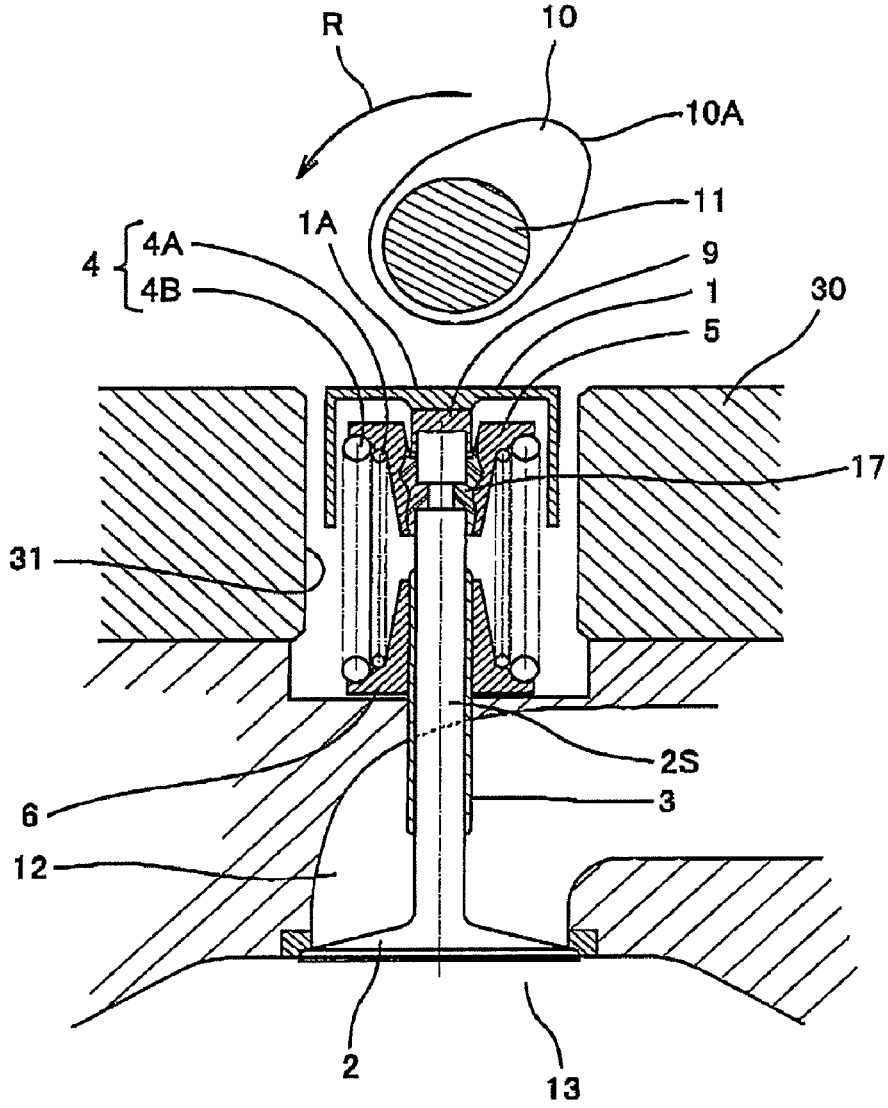
FIG. 1 is a partial cross-sectional view showing main components of a valve system of a cylinder head of an engine of a motorcycle.

Turning to FIG. 1, reference number 10 denotes a cam mounted on a camshaft 11, 1 denotes a tappet (also referred to as a lifter) having an upper surface (top surface) 1A configured to contact a peripheral surface 10A of the cam 10, 2 denotes a valve that is movable vertically in FIG. 1 by the tappet 1, 3 denotes a valve guide configured to slidably hold a stem 2S of the valve 2 on a base of a cylinder head 30, and 4 denotes a valve spring configured to elastically hold the tappet 1 in a position illustrated in FIG. 1. In this embodiment, the valve spring includes an inner spring 4A with a smaller diameter and an outer spring 4B with a larger diameter.

In FIG. 1, reference number 5 denotes a valve spring sheet upper (also referred to as a retainer) that is disposed between an upper end of the valve spring 4 and a shim 9 and is configured to hold the upper end of the valve spring 4, 6 denotes a valve spring sheet lower (also refereed to as a spring sheet) that is disposed between a lower end of the valve spring 4 and a base of the cylinder head and is configured to hold a lower end of the valve spring 4, and 17 denotes a valve cotter.

The valve system of the engine of the motorcycle constructed above operates as follows. When the cam 10 mounted on the camshaft 11 rotates as indicated by an arrow R (clockwise) in FIG. 1, the peripheral surface 10A of the cam 10 moves to contact the upper surface 1A of the tappet 1, pressing the tappet 1 downward. The tappet 1, which is elastically held in an upper position in FIG. 1 by the valve spring 4, is pressed downward against an elastic force exerted by the valve spring 4. Thereby, the valve stem 2S whose upper end is in contact with the shim 9 which is in contact with the tappet 1, i.e., the valve 2, moves downward, thereby allowing a passage (intake passage or exhaust passage) 12 to be connected to a combustion chamber 13. When the passage 12 is the intake passage, fresh air containing a fuel is supplied to the combustion chamber 13 through the passage 12, whereas when the passage 12 is the exhaust passage, a combustion gas is exhausted from the combustion camber 13 to the passage 12.

Figure 2:
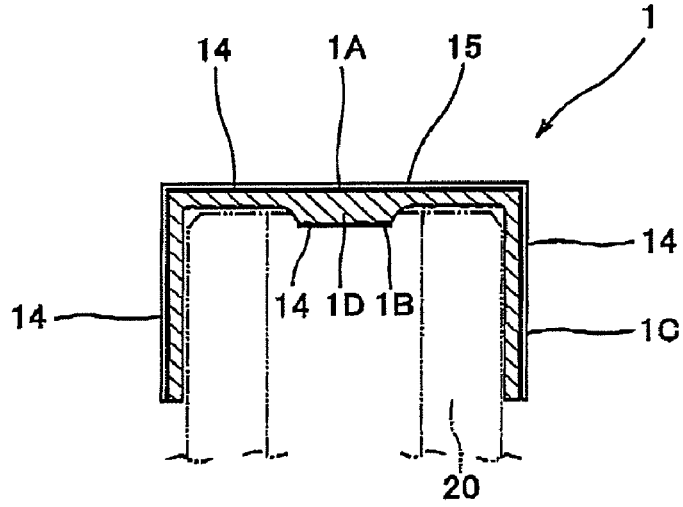
FIG. 2 is a longitudinal sectional view of the tappet of FIG. 1, which is obtained by sectioning the tappet at a center thereof.

The tappet 1 of this embodiment is made of titanium alloy of "Ti-6AL-4V (titanium alloy containing 6% aluminum and 4% vanadium)." As illustrated by an enlarged view of FIG. 2, the tappet 1 is of a cylindrical shape having a bottom portion. In this embodiment, a cylindrical tubular portion of the tappet 1 has a thickness of about 1 mm to 2 mm. The bottom portion (upper end in FIGS. 1 to 3) of the tappet 1 has a thickness of about 1.5 mm to 3 mm. The tappet 1 has, on an inner surface of the upper end, a thick portion 1D which is configured to contact the shim 9 (see FIG. 1). In this embodiment, the thick portion 1D has a thickness that is twice as large as that of the upper end. The tappet 1 with the above mentioned thickness and configuration has desired and sufficient stiffness and is lightweight in contrast to the tappet made of steel, for use with the valve system of the engine of the motorcycle 1. The weight of the tappet 1 is decreased about 40% as compared to the tappet made of steel. As a matter of course, the configuration and dimension of the tappet 1 are not intended only to those mentioned above.

An intermediate product of the tappet 1 manufactured to have the shape as described above is subjected to a process described below. This process enables the tappet 1 to be lightweight, and have high durability when used under a high load and high-speed rotation. In addition, the process enables the tappet 1 to have a low friction resistance.

First, the intermediate product of the tappet 1 manufactured to have the cylindrical shape with a closed upper end by a forming process such as forging, press forming, or cutting, is subjected to a carburizing process or a nitriding process. Among various processes as the carburizing process or the nitriding process, a plasma carburizing process or a plasma nitriding process is desirably carried out under a condition in which a temperature of a surface layer of the titanium alloy is 500° C. to 850° C. In FIG. 2, a carburized layer 14 of the tappet 1 that has been subjected to the carburizing process is indicated by a black bold line. In a temperature range of 500° C. or higher, carbon (C) or nitrogen (N) diffuse in a desirable state, whereas in a temperature range of 850° C. or lower, distortion caused by heat treatment does not substantially become problematic. Furthermore, in order to minimize the distortion or enable the carbon (C) and nitrogen (N) to sufficiently diffuse, the plasma carburizing process or the plasma nitriding process is desirably carried out under a temperature condition of 700 to 800° C. The carburizing process or the nitriding process enables the tappet 1 to have wear resistance and anti-sticking properties.

Figure 3:
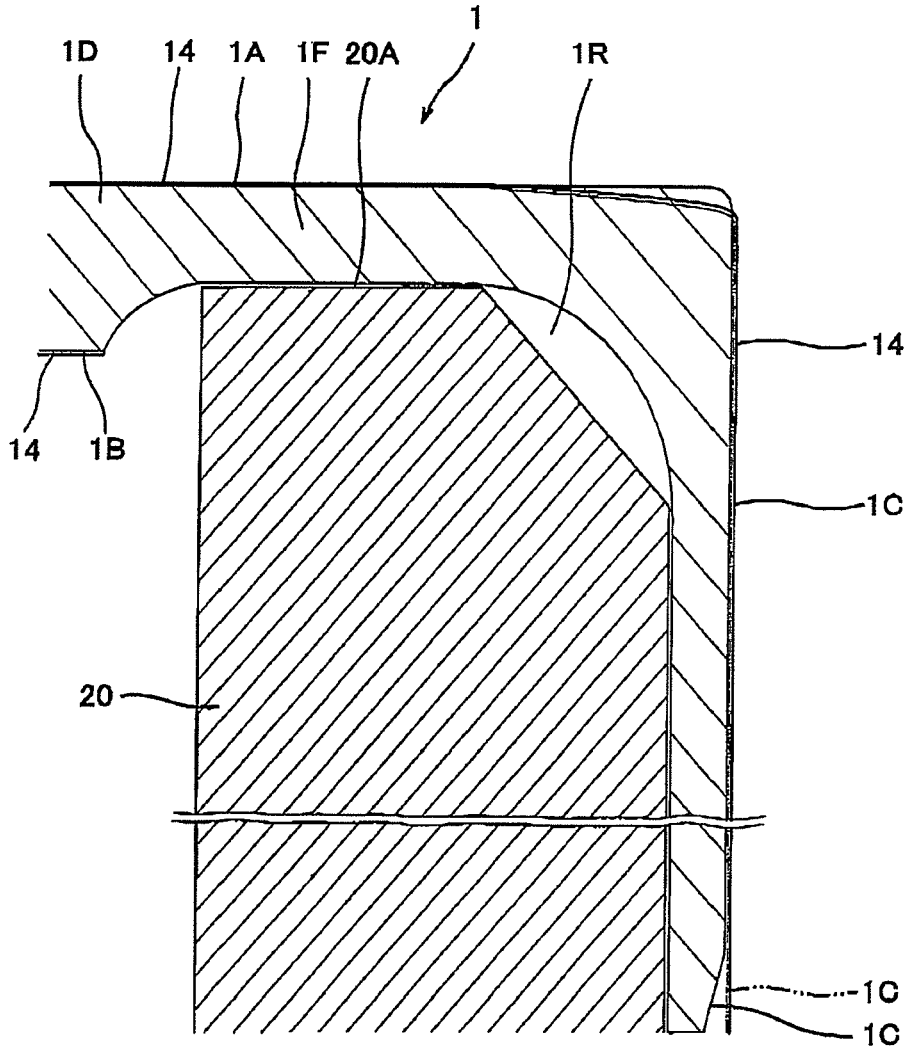
FIG. 3 is a partial cross-sectional view showing a substantially left half portion of the tappet of FIGS. 1 and 2, and an enlarged part of a jig used in a carburizing process of the tappet.

When the carburizing process is the plasma carburizing process, it is desirable to use a cylindrical (pipe-shaped) jig 20 that has a large wall thickness and has a right upper corner portion as shown in FIG. 3. To be specific, as shown in FIG. 3, the jig 20 is desirably structured such that the jig 20 does not cover a portion (center portion of an inner wall surface of an upper end of the tappet 1) which is a contact surface (lower surface of the thick portion 1D) 1B configured to contact the shim 9 (FIG. 1) and a corner portion 1R of the inner wall surface of the upper end of the tappet 1, and has a support surface 20A capable of supporting from the tappet 1 below, and an intermediate portion 1F (ring-shaped portion extending from a region located inward relative to an outer periphery to a region located radially outward relative to a center) of the upper end of the tappet 1, against a thermal load. Since the outer wall surface (upper surface 1A and outer peripheral surface 1C) of the tappet 1 and the contact surface 1B located at the center of the inner wall surface of the upper end of the tappet 1 are not covered with the jig 20 constructed as described above, they are hardened by the carburizing process (see carburized layer 14 of FIG. 3). In addition, since the corner portion 1R of the inner wall surface of the upper end is not supported below, the upper surface 1A is formed to have a crowning shape, which is curved to protrude slightly upward at the center thereof in the carburizing process as indicated by a curved bold line and a parallel two-dotted line. In FIG. 3, a bold line indicates a state of the tappet 1 before the carburizing process. In FIGS. 1 and 2, the shape of the tappet 1 is schematically illustrated by a straight line.

Then, an oxidization film is removed from the surface of the outer wall surface of the intermediate product of the cylindrical tappet 1 that has been subjected to the carburizing process. The oxidization film is desirably removed by any of grinding, etching, shot blasting, shot peening or sputtering. The process for removing the oxidization film may be selected depending on existing equipment. The oxidization film may be removed by other processes other than the above mentioned processes. In order to improve reliability of the process for removing the oxidization film, the sputtering is desirably employed. In order to increase production efficiency, the grinding is desirably employed. In order to reduce a manufacturing cost, the shot blasting is desirably employed.

The oxidization film is removed and then a DLC film 15 is formed as described below in vacuum atmosphere, nitrogen atmosphere, or hydrogen atmosphere so as not to form the oxidization film after the oxidization film is removed.

Then, the DLC film 15 (see FIG. 2) is formed on the outer wall surface of the intermediate product of the tappet 1 from which the oxidization film has been removed from its surface. The DLC film 15 may be formed by a physical deposition process or a chemical deposition process. The physical deposition process is desirable because a process temperature is lower. The chemical deposition process is desirable because so called throwing power to a three-dimensional shape is high. The throwing power means uneven adhesion to an entire surface of a complex shape structure.

The tappet 1 of this embodiment that has been subjected to above processes has a hardness of 550HV or higher, an effective hardening depth (carburized layer thickness) of 0.02 mm to 0.04 mm, and a surface hardness of 750 HV to 1050 HV, as a result of the plasma carburizing process.

The DLC film has a thickness of 1 μm to 3 μm and a surface hardness of 1000 HV to 1500 HV. In this embodiment, the tappet 1 has a surface roughness of Ry 1.6 μm.

In the tappet 1 constructed above, the DLC film 15 is formed on the outer peripheral surface 1C of the tappet 1 which is configured to contact a tappet hole 31 of a cylinder head 30, and its lower layer is subjected to the carburizing process as described above. In addition, the DLC film 15 is formed on the upper surface 1A of the tappet 1 which is configured to contact the cam 10, and the upper surface 1A is subjected to the carburizing process. Further, the contact surface 1B of the tappet 1 that is configured to contact the shim 9 is subjected to the carburizing process. Since the oxidization film is removed from the surface of the carburized layer 14 before formation of the DLC film 15, the tappet 1 has high durability and low friction resistance under a high load and a high-speed rotation. In addition, the weight of the tappet 1 is about 60% of the conventional tappet. For these reasons, the tappet 1 enables a higher speed when used with an engine configured to run at a high speed.

In the above embodiment, the present invention is applied to a tappet for use with an internal combustion engine of a motorcycle, but may be applied to tappets for use with internal combustion engines other than that of the motorcycle. The present invention may be widely applied to other components of the engine such as the valve, the valve spring sheet, the valve guide, a connecting rod (not shown), other engine components, or a front fork of the motorcycle. Furthermore, the present invention may be applied to components other than the engine, for example, an exhaust gas turbine or other shafts, especially shafts rotatable at a high speed or components of general machines, and the same functions and effects are provided.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A tappet for use with a valve system of an engine, the tappet comprising:

a bottom portion and a cylindrical tubular portion extending from the bottom portion, wherein an outer wall surface of the cylindrical tubular portion is configured to contact an inner peripheral surface of a tappet hole of the valve system of the engine and to be slidably supported in the tappet hole, and wherein an outer surface of the bottom portion is configured to slidably contact an outer peripheral surface of a cam of the engine, and wherein at least the outer wall surface of the cylindrical tubular portion and the outer surface of the bottom portion are subjected to a surface hardening process selected from the group consisting of a carburizing process and a nitriding process;

wherein the tappet is made of a titanium alloy; and wherein after removing an oxidization film from the surfaces which have been subjected to the surface hardening process, a diamond like carbon film is formed on the surfaces.

2. The tappet according to claim 1, wherein a diamond like carbon film is formed on the surface that has been subjected to the carburizing process.

3. The tappet according to claim 1, wherein the tappet is formed of titanium alloy which is Ti-6Al-4V.

4. The tappet according to claim 1, wherein an upper surface of the tappet has a crowning shape in which a center portion thereof is curved to protrude slightly upward.

5. A method of manufacturing a tappet for use with a valve system of an engine, the method comprising:

forming the tappet from a titanium alloy to have a bottom portion and a cylindrical tubular portion extending from the bottom portion, wherein an outer wall surface of the cylindrical tubular portion is configured to contact an inner peripheral surface of a tappet hole of the valve system of the engine and to be slidably supported in the tappet hole, and wherein an outer surface of the bottom portion is configured to slidably contact an outer peripheral surface of a cam of the engine, and wherein the tappet is formed to have a center region of an inner surface of the bottom portion in a bottom view that has a thick wall region that protrudes downward and is configured to drive a valve of the engine; and causing the tappet to be subjected to a carburizing process using a jig placed in contact with the inner wall surface of the bottom portion of the tappet except for a corner portion of the inner wall surface of the tappet and a center region of the inner wall surface of the bottom of the tappet in a region extending from a point that is apart from an intersection line of the inner surface of the bottom portion and an inner wall surface of the cylindrical tubular portion toward a center of the bottom portion to a point that is close to the center, the point being located outward of the thick wall region;

after the carburizing process, removing an oxidization film; and forming a diamond like carbon film on at least the outer surface of the bottom portion and the outer wall surface of the cylindrical tubular portion, wherein the diamond like carbon film is formed by a physical deposition process or a chemical deposition process.

6. The method of manufacturing the tappet according to claim 5, wherein the tappet is formed of titanium alloy which is Ti-6Al-4V.

7. The method according to claim 5, wherein removing the oxidization film after the carburizing process includes one of grinding, etching, shot blasting, shot peening, or sputtering.

8. The tappet according to claim 5, wherein an upper surface of the tappet has a crowning shape in which a center portion thereof is curved to protrude slightly upward.

9. A method of manufacturing a tappet for use with a valve system of an engine, the method comprising:

forming the tappet from a titanium alloy to have a bottom portion and a cylindrical tubular portion extending from the bottom portion, wherein an outer wall surface of the cylindrical tubular portion is configured to contact an inner peripheral surface of a tappet hole of the valve system of the engine and to be slidably supported in the tappet hole, and wherein an outer surface of the bottom portion is configured to slidably contact an outer peripheral surface of a cam of the engine, and wherein the tappet is formed to have a center region of an inner surface of the bottom portion in a bottom view that has a thick wall region that protrudes downward and is configured to drive a valve of the engine; and causing the tappet to be subjected to a carburizing process using a jig placed in contact with the inner wall surface of the bottom portion of the tappet in a region extending from a point that is apart from an intersection line of the inner surface of the bottom portion and an inner wall surface of the cylindrical tubular portion toward a center of the bottom portion to a point that is close to the center, the point being located outward of the thick wall region;

wherein the carburizing process is a plasma carburizing process carried out under a condition in which a temperature of a surface layer of titanium alloy is 500° C. to 850° C.

10. A method of manufacturing a titanium alloy tappet for use with a valve system, comprising:

forming the tappet to have an external wall in a tubular shape and a bottom;

causing the tappet having the tubular shape and the bottom to be subjected to a carburizing process using a jig placed in contact with an inner wall surface of the tappet except for a corner portion of the inner wall surface of the tappet and a center region of the inner wall surface of an upper end of the tappet; and wherein the tappet is formed of titanium alloy which is Ti-6Al-4V.

11. A method of manufacturing a titanium alloy tappet for use with a valve system, comprising:

forming the tappet to have a tubular shape and a bottom;

causing the tappet having the tubular shape and the bottom to be subjected to a carburizing process using a jig placed in contact with an inner wall surface of the tappet except for a corner portion of the inner wall surface of the tappet and a center region of the inner wall surface of an upper end of the tappet; and wherein the carburizing process is a plasma carburizing process carried out under a condition in which a temperature of a surface layer of titanium alloy is 500° C. to 850° C.

* * * * *

UNITED STATES PATENT AND TRADEMARK OFFICE

CERTIFICATE OF CORRECTION

PATENT NO. : 7,621,244 B2
APPLICATION NO. : 11/377241
DATED : November 24, 2009
INVENTOR(S) : Matsuda et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 171 days.

Signed and Sealed this

Twenty-sixth Day of October, 2010

David J. Kappos

David J. Kappos
*Director of the United States Patent and Trademark Office*